US005687552A

United States Patent [19]

Barca

[11] Patent Number: 5,687,552

[45] Date of Patent: Nov. 18, 1997

[54] ADAPTER SYSTEM FOR A CAPPING MACHINE FOR APPLYING AT LEAST ONE PREDETERMINED AXIAL LOAD

[75] Inventor: John G. Barca, Dublin, Ohio

[73] Assignee: Abbott Laboratories, Abbott Park, Ill.

[21] Appl. No.: 620,047

[22] Filed: Mar. 20, 1996

[51] Int. Cl.[6] ..... B67B 3/20; B65B 7/28

[52] U.S. Cl. ..... 53/490; 53/306; 53/317; 53/331.5

[58] Field of Search ..... 53/490, 317, 331.5, 53/368, 306, 308

[56] References Cited

U.S. PATENT DOCUMENTS

| | | | |
|---|---|---|---|
| 4,254,603 | 3/1981 | Obrist | 53/331.5 X |
| 4,295,320 | 10/1981 | Willingham | 53/331.5 X |
| 4,485,609 | 12/1984 | Kowal | 53/331.5 |
| 4,979,350 | 12/1990 | Arnemann | 53/331.5 |
| 5,437,139 | 8/1995 | Martin | 53/331.5 X |

*Primary Examiner*—Horace M. Culver
*Attorney, Agent, or Firm*—Brian R. Woodworth

[57] ABSTRACT

An adapter system is provided for a capping machine. A first adapter is mounted on the capping machine spindle. A second adapter carries the capping head and is axially movable on the first adapter. The second adapter is urged with an axial capping load to an extended position relative to the first adapter. The spindle can be moved to a second position while rotating to engage the cap with the container and move the first adapter axially toward the second adapter. A travel stop can be provided to impose a higher, initial load on the cap when the cap thread initially engages the container thread. After the initial engagement, the rotating spindle effects continued threaded engagement of the cap which, owing to the helical thread engagement, moves downwardly on the container thread under a lower axial capping load. The travel stop can also be omitted to provide a single axial capping load.

8 Claims, 12 Drawing Sheets

ADAPTER SYSTEM FOR A CAPPING MACHINE FOR APPLYING AT LEAST ONE PREDETERMINED AXIAL LOAD

TECHNICAL FIELD

This invention relates to automatic capping machines which apply caps or closures to containers.

BACKGROUND OF THE INVENTION

Automatic capping machines are employed to apply caps to containers such as plastic or glass bottles. Automatic capping machines typically include a capping spindle and capping chuck which are rigidly connected together. The capping chuck holds the cap and is moved downwardly by the capping spindle to apply the cap to a container.

Typically, the cap and the container have complementary threads formed thereon so that the cap can be threadingly engaged on the container. The capping chuck is rotated to thread the cap onto the container. With one type of conventional capping machine, the capping spindle forces the chuck downwardly toward the container with about 35 pounds of force.

Such capping machines are typically employed with a variety of caps and containers, including plastic caps and plastic bottles. A plastic cap may also include an integral or unitary tamper band which must be initially forced over the container threads. The use of conventional capping machines to apply plastic caps, especially caps with tamper bands, can result in production problems.

Sometimes caps are not threaded properly or completely onto the containers, and production runs may result in relatively high scrap rates. When tamper bands are included on the cap, there is a likelihood that the tamper band will break during the capping process. Indeed, with conventional capping machines that employ relatively high capper column top loading forces during the entire capping operation, a plastic cap with a unitary tamper band typically snaps over the bottle threads rather than being threaded onto the bottle threads. This creates high stresses in the tamper band and high friction between the cap and bottle threads.

Some types of conventional capping machine systems use the total capper column weight plus an extra downward spring force to keep the capping chuck jaws engaged around the outside surface of the cap. The downward force causes the cap chuck to grip the cap, but this increases the rate of tamper band breakage. Further, this produces plastic particulate material as a result of the interference between the plastic cap and the plastic bottle.

Production of plastic particulate matter is undesirable because such particulate matter on the container and in the thread region is visually unappealing when the container is later opened. Further, the particulate material created during the capping process may become trapped in the thread region of the container, and may later fall into the container when the cap is removed.

In order to minimize these problems, conventional systems must be operated at lower production speeds, but even that does not eliminate the problems.

The present invention provides an adapter system for a capping machine to apply at least one predetermined axial load in a manner that eliminates or minimizes the above-discussed problems.

SUMMARY OF THE INVENTION

According to the present invention, a novel adapter system can be employed to install a cap on a container with one predetermined axial capping load, or, alternatively, can be employed to install a cap on a container by sequentially applying a first, maximum axial capping load and then a second, lower, axial capping load.

This system eliminates or substantially minimizes the creation of particulate matter when used to install a plastic cap on a plastic container. Further, the system is especially effective when installing a threaded cap having an integral tamper band.

According to one aspect of the invention, an apparatus is provided for use in a capping machine that has (1) a rotatable spindle that is reciprocable between a first position and a second position, and (2) a capping head for holding a threaded cap.

The apparatus includes a first adapter mounted on the spindle and a second adapter carrying the capping head. The second adapter is mounted to the first adapter to accommodate relative axial movement of the first and second adapters.

Means are provided for urging the adapters to an orientation in which the second adapter is at an extended position relative to the first adapter. When the spindle is moved to the second position while rotating to place the cap in contact with the container, the first adapter moves axially relative to the second adapter while a predetermined, constant axial capping load is applied to the cap independently of the spindle weight and the cap thread begins to engage the container thread. Subsequently, the second adapter moves with the cap relative to the first adapter further away from the spindle as the thread engagement between the container and cap increases while the cap remains subjected to the predetermined axial capping load.

According to another aspect of the invention, a modified form of the apparatus can sequentially apply a maximum predetermined axial capping load and then a predetermined lower axial capping load while installing the cap on the container. The apparatus for practicing this aspect of the invention also includes a first adapter mounted on the spindle and a second adapter carrying the capping head. The second adapter is mounted on the first adapter to accommodate relative axial movement of the adapters between (1) a collapsed orientation in which the second adapter is prevented by engagement with the first adapter from moving closer to the spindle, and (2) an extended orientation in which the second adapter is prevented by engagement with the first adapter from moving further away from the spindle.

Means are provided for urging the adapters to the extended orientation. When the spindle is moved to the second position while rotating to contact the cap with the container, the first adapter moves axially against the second adapter to apply the maximum axial capping load to the cap. The cap is subjected to the maximum axial capping load only until the cap thread begins to engage the container thread. When that occurs, the second adapter moves with the cap relative to the first adapter away from the spindle to axially disengage from the first adapter as the thread engagement between the container and cap increases such that the cap is subjected to the lower axial capping load.

Numerous other advantages and features of the present invention will become readily apparent from the following detailed description of the invention, from the claims, and from the accompanying drawings.

BRIEF DESCRIPTION OF THE DRAWINGS

In the accompanying drawings that form part of the specification, and in which like numerals are employed to designate like parts throughout the same.

DESCRIPTION OF THE PREFERRED EMBODIMENT

While this invention is susceptible of embodiment in many different o forms, this specification and the accompanying drawings disclose some specific forms as examples of the invention. The invention is not intended to be limited to the embodiments so described, however. The scope of the invention is pointed out in the appended claims.

For ease of description, the adapter system of this invention is described in the normal (upright) operating position, and terms such as upper, lower, horizontal, etc., are used with reference to this position. It will be understood, however, that the adapter system of this invention may be manufactured, stored, transported, used, and sold in an orientation other than the position described.

Figures illustrating the adapter system show some mechanical elements that are known and that will be recognized by one skilled in the art. The detailed descriptions of such elements are not necessary to an understanding of the invention, and accordingly, are herein presented only to the degree necessary to facilitate an understanding of the novel features of the present invention.

The adapter system of this invention is used with certain conventional components the details of which, although not fully illustrated or described, will be apparent to those having skill in the art and an understanding of the necessary functions of such components.

Figure 1:
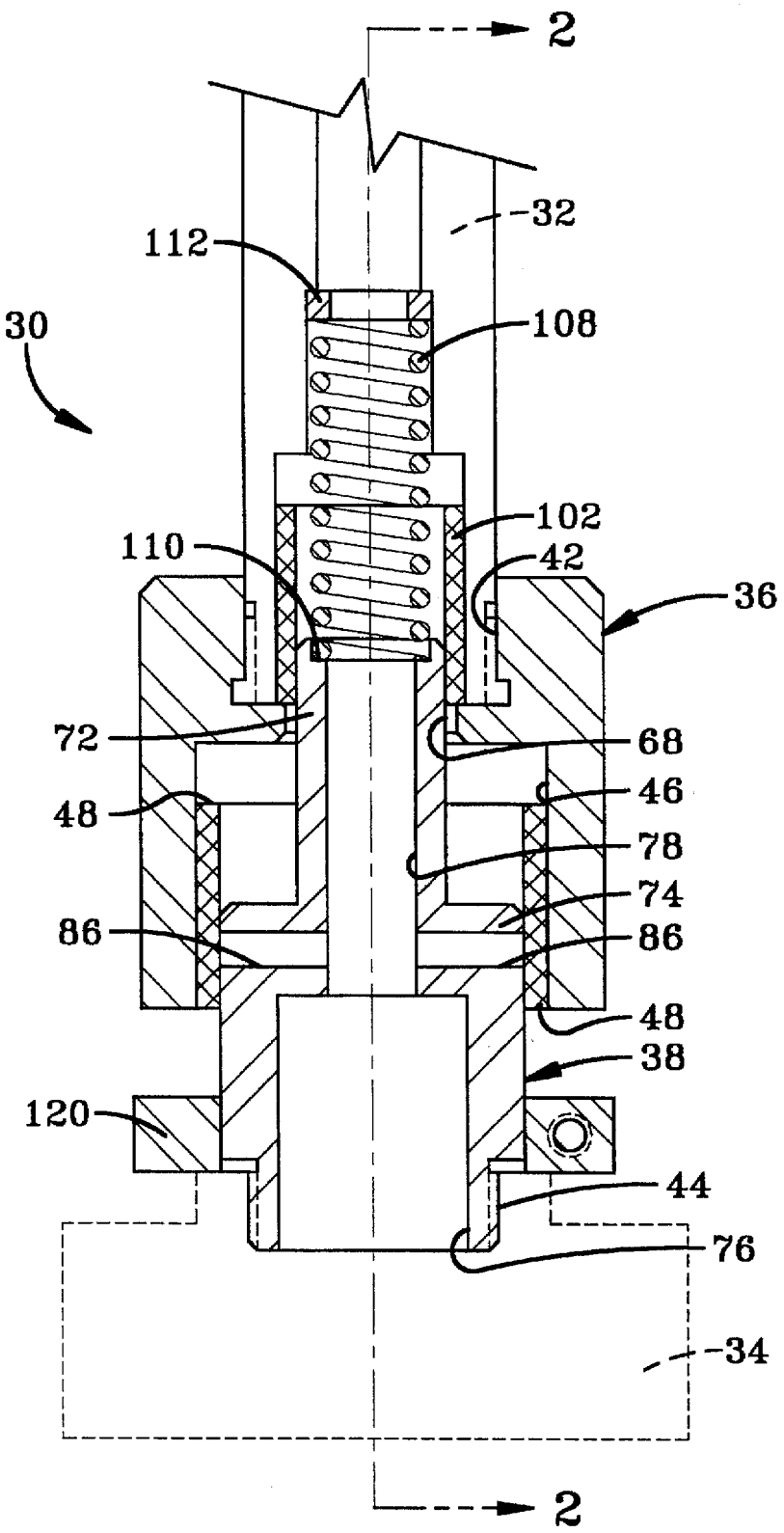
FIG. 1 is a simplified, cross-sectional view of the adapter system of the present invention with the first adapter shown mounted on a conventional capping machine spindle (which is illustrated in phantom by dashed lines) and with the second adapter carrying a capping head (which is illustrated in phantom by dashed lines)

The adapter system of the present invention is designated generally by the reference numeral 30 in FIG. 1. The adapter system 30 is suitable for use with conventional or special capping machines which have a rotatable spindle 32 that is reciprocable (typically vertically) between a first position (e.g., a first elevated position) and a second position (e.g., a fully lowered position). Conventional or special capping machines typically include a capping head 34 which includes a chuck comprising jaws or other suitable cap gripping mechanisms. The detailed design and operation of the capping machine, including the spindle 32 and the capping head 34, form no part of the present invention. Typically, the capping head 34 is mounted directly to the lower, distal end of the capping machine spindle 32. According to the teachings of the present invention, the adapter system 30 is designed to be installed between the lower distal end of the spindle 32 and the upper end of the capping head 34.

The adapter system 30 includes a first adapter 36 and a second adapter 38. The first adapter 36 is mounted to the lower, distal end of the capping machine spindle 32 by any suitable releasable or permanent means. In the preferred embodiment illustrated, the first adapter 36 includes a threaded bore 42 (FIGS. 1 and 5) for threadingly engaging a mating thread on the spindle 32.

The second adapter 38 may be mounted to the capping head 34 by any suitable releasable or permanent means. In the preferred embodiment illustrated, the second adapter 38 includes a male threaded lower end 44 for threadingly engaging a mating female thread on the capping head 34.

The first adapter 36 defines a large, lower, receiving bore 46 for receiving a portion of the second adapter 38 and an annular bushing 48. A vertical air vent channel 32 (FIG. 5) is provided in the side of the bore 46 to permit the ingress and egress of ambient air to accommodate movement of the slidable, but closely fitted, components as described in detail hereinafter.

The adapter 36 also has a reduced diameter bore 68 (FIGS. 5 and 6) between upper bore 42 and the large, lower bore 46. The reduced diameter bore 68 is adapted to receive a portion of the second adapter 38 as illustrated in FIG. 1.

The upper exterior portion of the first adapter 36 is provided with two holes 54 for receiving an appropriate tool used to rotate the adapter 36 when threading the adapter on or off of the capping machine spindle 32. In some applications, it may be desirable to provide two additional holes 90 degrees from the two holes 54 illustrated in FIGS. 4 and 5.

Figure 4:
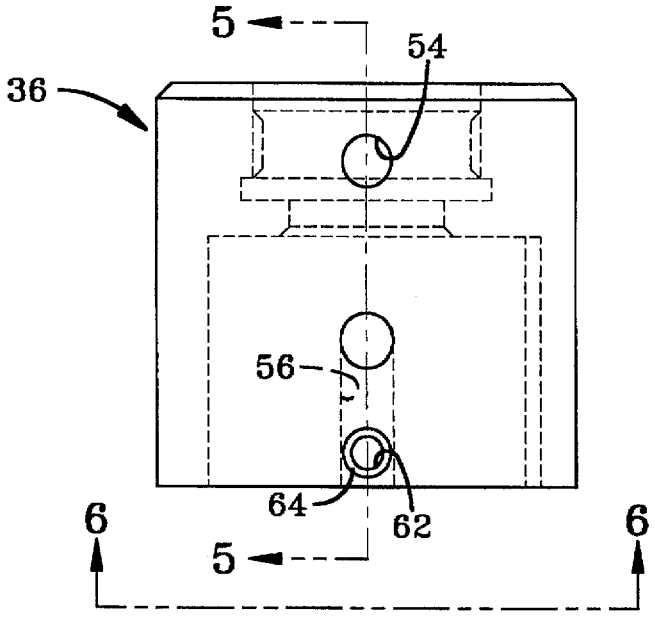
FIG. 4 is a side elevational view of the first adapter rotated 90 degrees from the position shown in FIG. 2.

The first adapter 36 defines a pair of slots or keyways 56 which extend from the bottom of the first adapter 36 to an arcuate upper end surface 58. Extending through the adapter 36 into each keyway 56 is a bore 62. The exterior cylindrical surface of the adapter 36 is spot faced around the periphery of the bore 62 as shown at 64 (FIG. 4). The bores 62 are provided to receive allen head bolts as described hereinafter, and the keyways 56 are provided to receive keys as described hereinafter.

At the upper end of each keyway 56 there is another bore 66 which extends through the adapter 36, and the upper surface of each bore 66 defines the arcuate surface 58 at the top of each keyway 56. The bores 66 are provided to facilitate machining of the adapter 36.

Figure 7:
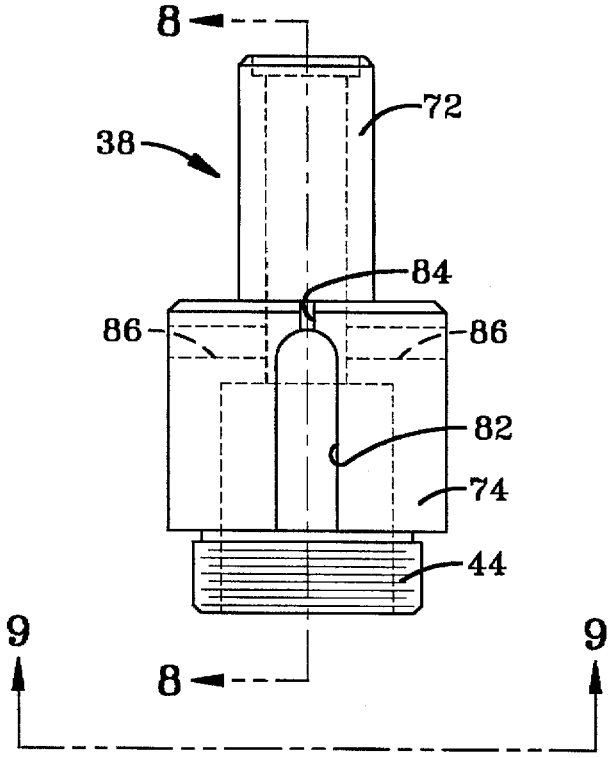
FIG. 7 is a side elevational view of the second adapter rotated 90 degrees from the position shown in FIG. 2.
Figure 8:
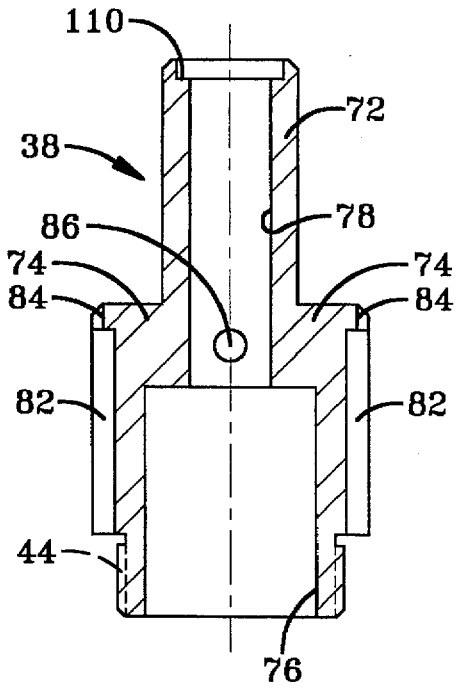
FIG. 8 is a cross-sectional view taken generally along the plane 8—8 in FIG. 7.
Figure 9:
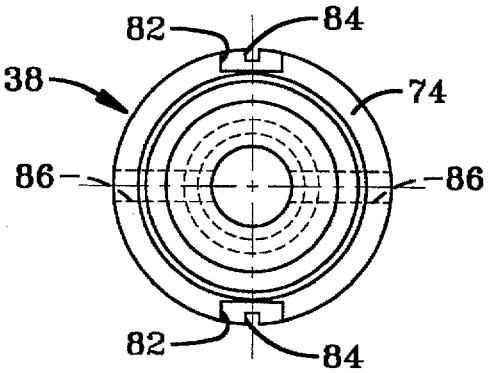
FIG. 9 is a bottom plan view taken generally along the plane 9—9 in FIG. 7.
Figure 10:
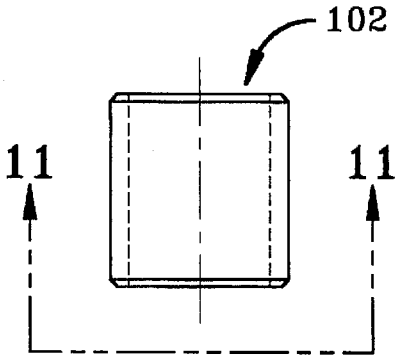
FIG. 10 is a side elevation view of the upper bushing.

The second adapter 38 has a reduced diameter upper portion 72 and a larger diameter lower portion 74 (FIGS. 7–9). The larger diameter lower portion 74 defines an internal, large bore 76, and the smaller diameter portion 72 defines a smaller diameter bore 78 which communicates with the large diameter bore 76 (FIG. 8).

The exterior surface of the large diameter portion 74 defines two slots or keyways 82 (FIGS. 7–8) which each terminates in an arcuate upper end surface. A shallower and narrower slot 84 extends from the upper end of each keyway 82 and functions as an air vent to permit the ingress and egress of air during movement of the components of the apparatus as described in detail hereinafter.

Two holes 86 (FIGS. 7–9) are provided to receive a suitable tool to assist in rotating the second adapter 38 when threading the adapter 38 on or off of a capping head 34 (FIG. 1).

Figure 2:
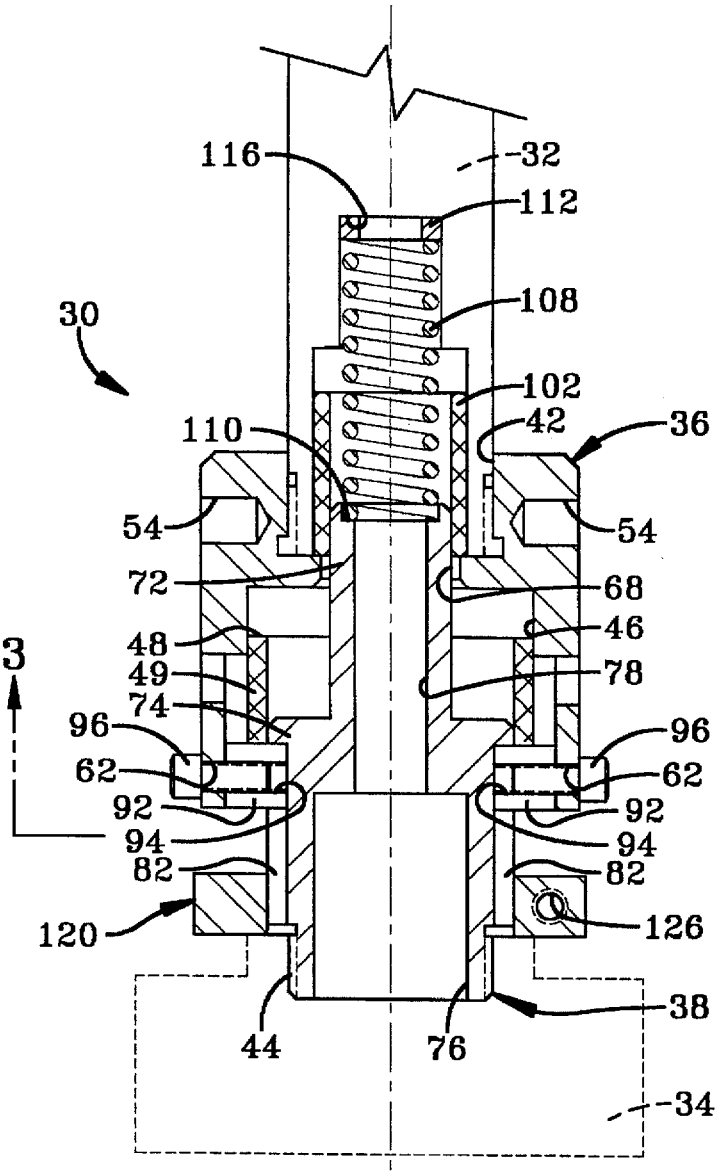
FIG. 2 is a cross-sectional view taken generally along the plane 2—2 in FIG. 1.
Figure 3:
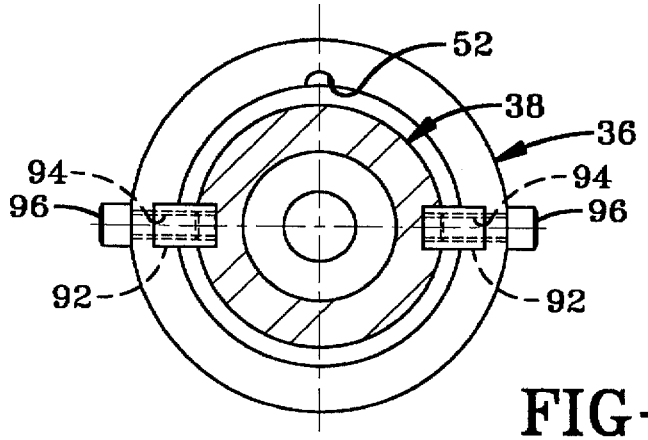
FIG. 3 is a cross-sectional view taken generally along the plane 3—3 in FIG. 2.
Figure 16:
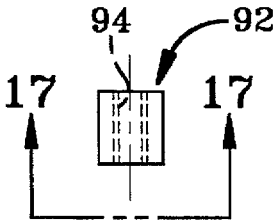
FIG. 16 is a top plan view of one of the two identical keys.
Figure 15:
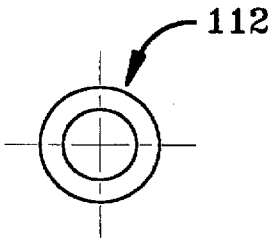
FIG. 15 is a bottom plan view taken generally along the plane 15—15 in FIG. 14.
Figure 17:
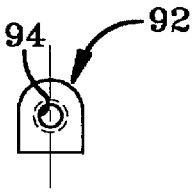
FIG. 17 is an elevational end view taken generally along the plane 17—17 in FIG. 16.
Figure 19:
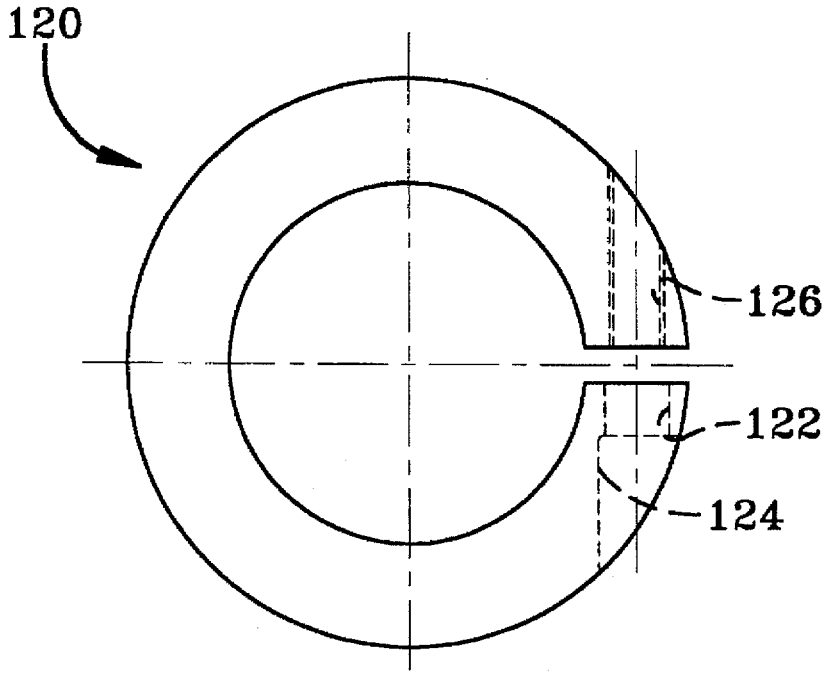
FIG. 19 is a bottom plan view taken generally along the plane 19—19 in FIG. 18.
Figure 18:
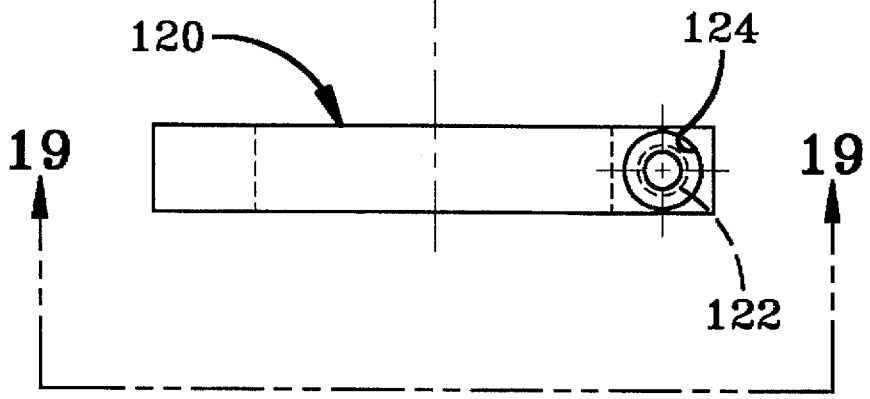
FIG. 18 is a side elevational view of the travel stop collar.

As illustrated in FIGS. 2 and 3, the second adapter 38 is slidably disposed within the first adapter 36. In the assembled, rest position illustrated in FIGS. 2 and 3, the lower adapter 38 is held at a lower, extended position relative to the first adapter 36. To this end, the arcuate upper end of each slot 82 in the second adapter 38 rests on a key 92 mounted to the first adapter 36. As shown in FIG. 16, the upper end of each key 92 is arcuate to match the upper end of each slot 82 in the second adapter 38.

Figure 5:
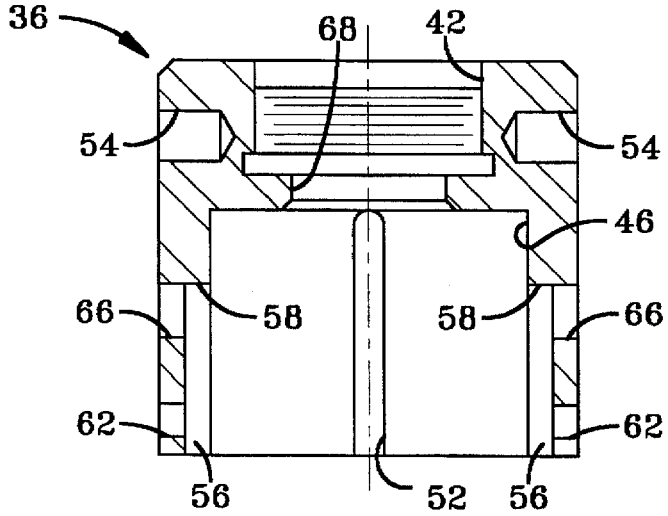
FIG. 5 is a cross-sectional view taken generally along the plane 5—5 in FIG. 4.
Figure 6:
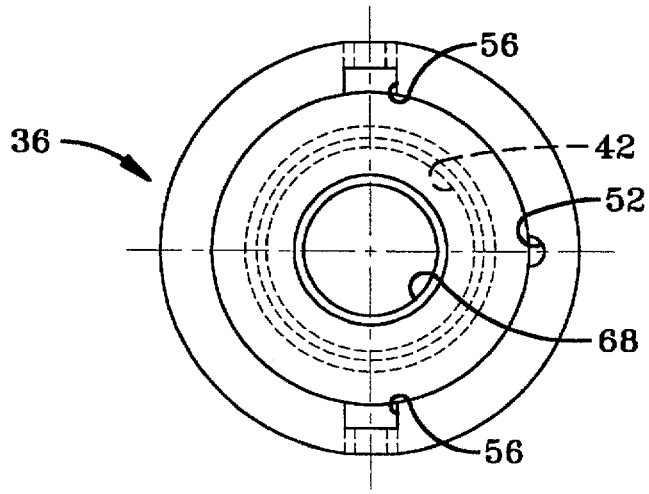
FIG. 6 is a bottom plan view taken generally along the plane 6—6 in FIG. 4.
Figure 12:
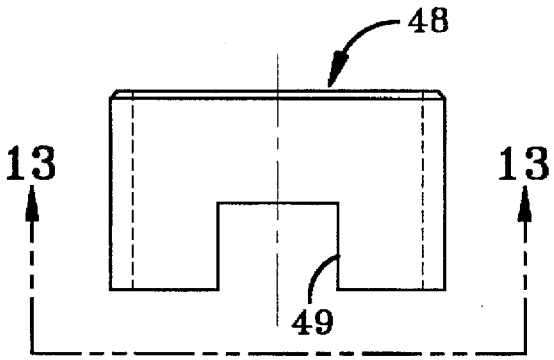
FIG. 12 is a side elevational view of the lower bushing.
Figure 11:
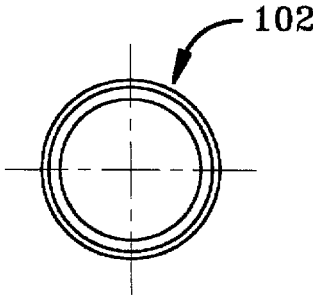
FIG. 11 is a bottom plan view taken generally along the plane 11—11 in FIG. 10.
Figure 13:
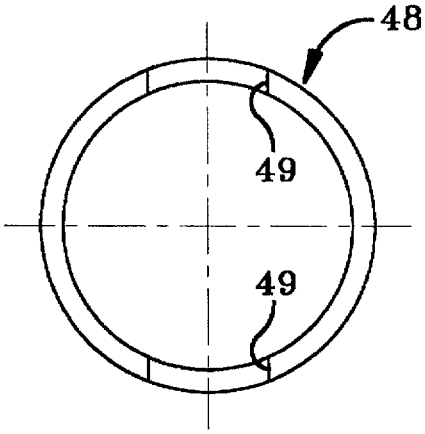
FIG. 13 is a bottom plan view taken generally along the plane 13—13 in FIG. 12.
Figure 14:
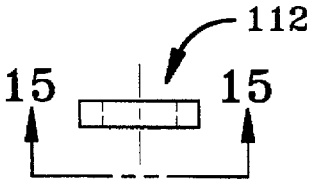
FIG. 14 is a side elevational view of the spring bearing washer.

Each key 92 defines a threaded bore 94 for receiving the threaded shank of an allen screw 96. The shank of the allen screw 96 extends through the first adapter bore 62 (FIGS. 2, 4, and 5). The screws 96 hold the keys 92 in place on the first adapter 36. The second adapter 38 is permitted to reciprocate inwardly and outwardly relative to the first adapter 36, and the maximum outward extension of the second adapter 38 relative to the first adapter 36 is determined by the engagement between the keys 92 and the upper arcuate ends of the second adapter keyways 82. The maximum extension of the second adapter 38 relative to the first adapter 36 is shown in FIGS. 1 and 2. The sliding, reciprocable movement of the second adapter 38 in the first adapter 36 is accommodated by the bushing 48 disposed between the outside of the second adapter portion 74 (FIG. 2) and the inner surface of the first adapter lower bore 46 (FIG. 2). The bushing 48 includes a pair of notches 49 in the lower edge (FIGS. 12 and 13) to accommodate the keys 92. The keys 92 cooperate with the second adapter keyways 82 to prevent the two adapters 36 and 38 from rotating relative to each other.

As illustrated in FIGS. 1 and 2, the smaller diameter, upper portion 72 of the second adapter 38 extends up through the first adapter intermediate bore 68 into the first adapter upper bore 42. The spindle 32 is received in the first adapter upper bore 42 outwardly of the second adapter upper portion 72. An annular bearing 102 is provided between the outer surface of the second adapter upper portion 72 and the inner surface of the annular spindle 32 to accommodate the sliding movement of the second adapter 38 upwardly and downwardly.

The upper end of the reduced diameter portion 72 of the second adapter 38 is biased downwardly by a spring 108. The upper, distal end of the second adapter 38 defines an annular shoulder 110 (FIGS. 1, 2, and 8) for receiving the bottom end of the spring 108. The upper end of the spring 108 bears against a bearing washer 112 (FIGS. 1, 2, 14, and 15) which is seated against a shoulder 116 or other suitable portion of the capping machine spindle 32.

If the capping machine is a conventional, vertically oriented capping machine, the spring 108 could be omitted in some applications where the combined weight of the second adapter 38, capping head 34, and cap is sufficient to provide the desired axial load during threading of the cap on the container. In a presently preferred design, the weight of the second adapter 38 and cap carried by the capping head is between about 2 and about 3 pounds. The force of the spring 108 is between about 2 and about 3 pounds. The total axial capping load applied to the cap during the threading of the cap onto the container is about 5 pounds.

Figure 22:
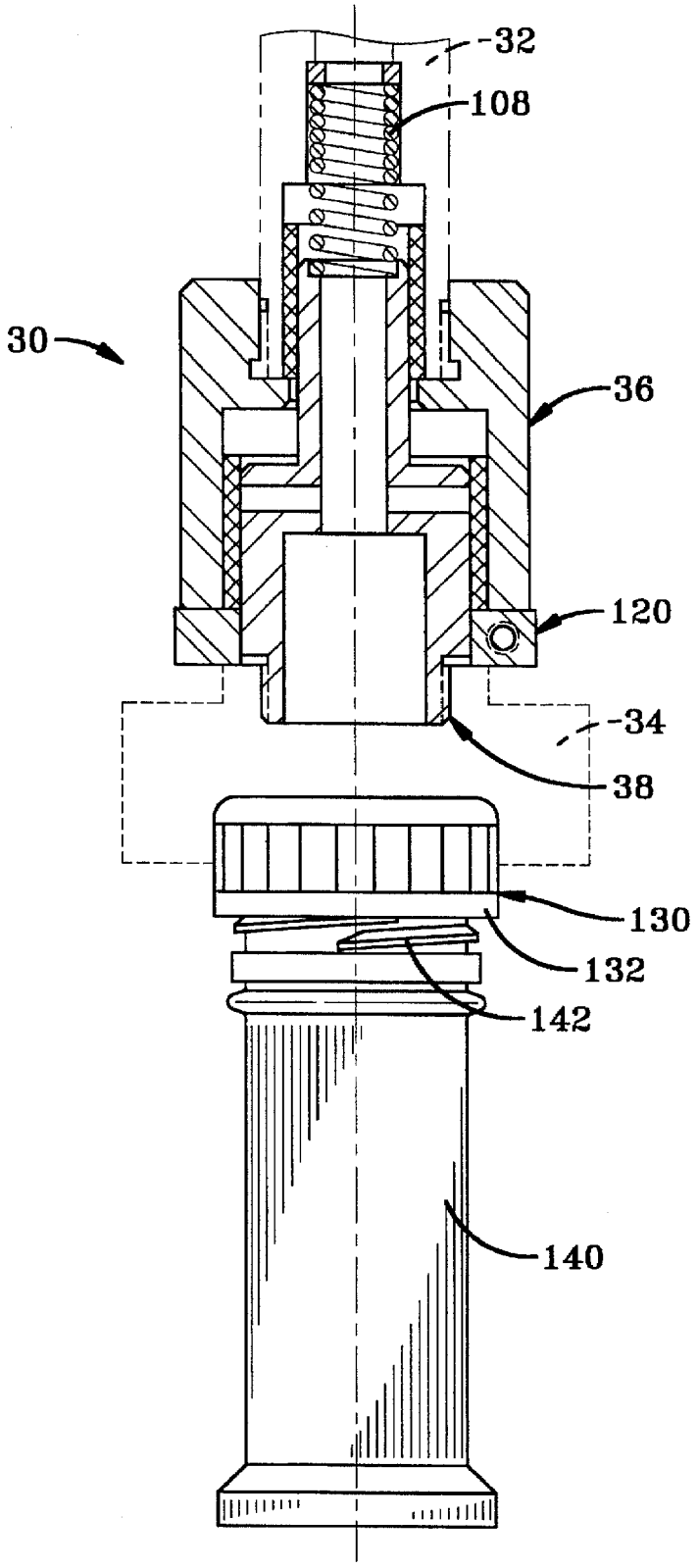

A travel stop collar 120 (FIGS. 1, 2, 18, and 19) is fixed to the exterior cylindrical surface of the second adapter 38 as shown in FIGS. 1 and 2. The collar 120 incorporates a clamp ring design having a bore 122, a counter bore 124, and a threaded bore 126 aligned with the bore 122 for threadingly engaging a suitable bolt for clamping the collar 120 tightly about the second adapter 38. The travel stop collar 120 may be regarded as an integral part of the second adapter 38. In some applications, it may be desirable to provide the travel stop collar 120 as a unitary part, or extension, of the second adapter 38. When the first adapter 36 moves downwardly relative to the second adapter 38, the bottom of the first adapter 36 abuts the top surface of the travel stop collar 120 as shown in FIG. 22 to limit the downward movement of the first adapter 36 relative to the second adapter 38.

The operation of the adapter system 30 is next described with reference to FIGS. 20–25 which sequentially illustrate the installation of a threaded cap 130 on a threaded container 140. The apparatus 30 is ideally suited for use in applying a cap 130 having a tamper band 132 along the bottom peripheral edge which must be temporarily deformed radially outwardly and forced over the container threads 142 until the band 132 snaps below the container threads 142 or some other feature on the container 140. The detailed design and operation of such a tamper band 132 forms no part of the present invention.

Figure 20:
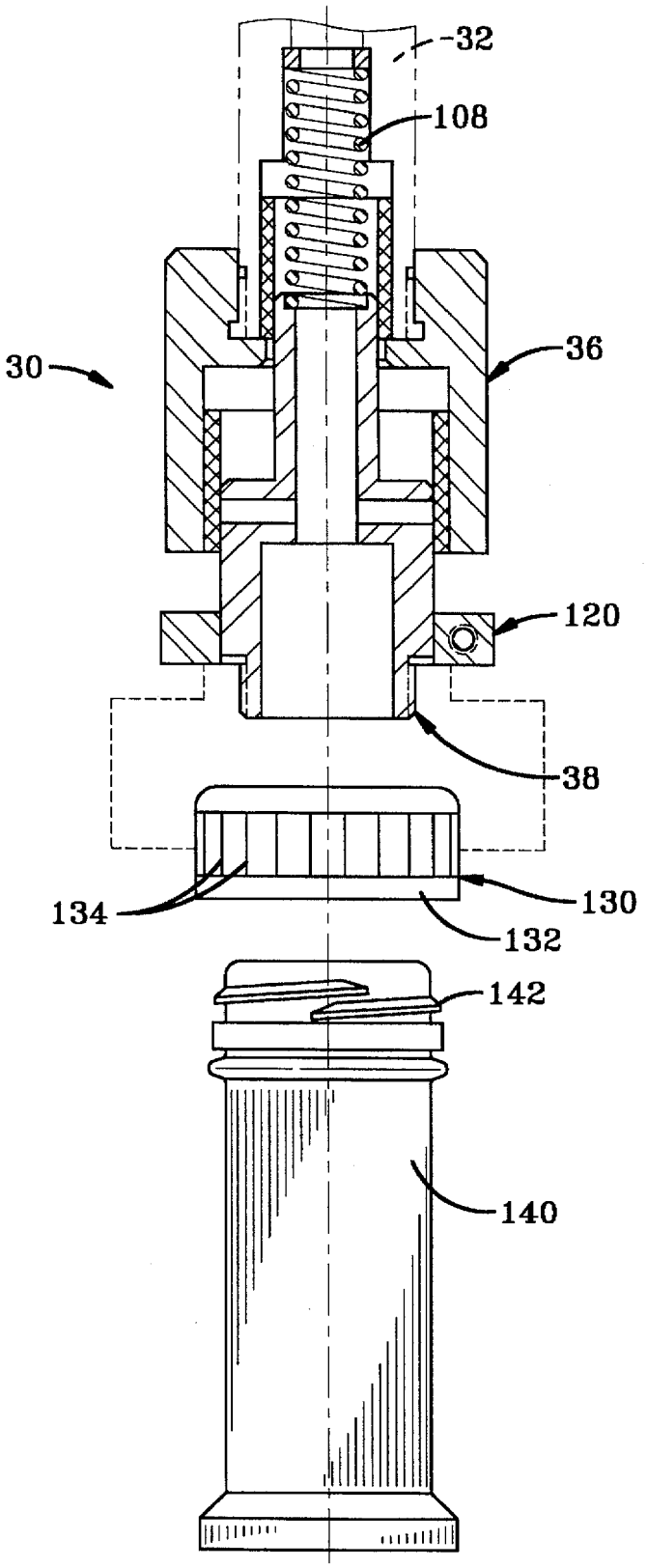
FIGS. 20–25 are cross-sectional views similar to FIG. 1 showing sequential moved positions of the apparatus in operation to apply a threaded cap to a threaded container.

The cap 130 is schematically illustrated as also including a plurality of vertical ribs or serrations 134 above the tamper band 132 (FIG. 20). The ribs 134 may be gripped by suitable jaws or other engaging members (not shown) in the capping head 34. The present invention does not require that a cap 130 be provided with such vertical serrations or ridges 134.

The capping head 134 is loaded with a cap 130 (typically by an automatic, conventional system, the details of which form no part of the present invention). The capping head 34 includes suitable conventional or special mechanisms for gripping the cap 130 securely. The capping head 34 may employ spring-biased jaws or self-energizing, pivoting, clamping jaws which pivot inwardly to grip the side of the cap when the top of the cap forces a radially inwardly extending arm of the jaw upwardly. The details of such capping head mechanisms form no part of the present invention.

Typically, in a conventional capping machine, the spindle 32 is moved through a circular path, and an appropriate star wheel conveyor system conveys the container 140 below the spindle 32 in a coincident circular path. An example of such a system is described in a U.S. Patent Application entitled, "Container Rotation Arrester" filed by John Barca, the applicant herein, and William Zuck on the same date that this application was filed. That application is incorporated herein by reference.

Initially, as illustrated in FIG. 20, the capping machine spindle 32 is at a first, elevated position wherein the cap 130 is held above the container 140. The two adapters 36 and 38 are in an extended orientation wherein the second adapter 38 is prevented from moving further away from the first adapter 36 by the keys 92 (FIG. 1).

Typically, the spindle 32 is also continuously rotating about its longitudinal axis. However, it is not required that the spindle 32 continuously rotate. The spindle 32 may be intermittently rotated only when necessary to effect the threading of the cap 130 onto the container 140. When the spindle 32 is rotated about its vertical, longitudinal axis, the first adapter 36, which is fixed to the lower, distal end of the spindle 32, also rotates. Owing to the fact that the keys 92 (FIG. 2) key the second adapter 38 to the first adapter 36, the second adapter 38 also rotates with the first adapter 36 and spindle 32. Because the capping head 34 is fixed to the bottom of the second adapter 38, the capping head 34 also necessarily rotates with the spindle 32, and this rotates the engaged cap 130 relative to the container 140 which is restrained against rotation by suitable means (not illustrated) which may be of any appropriate conventional or special design (the details of which form no part of the present invention).

Figure 21:
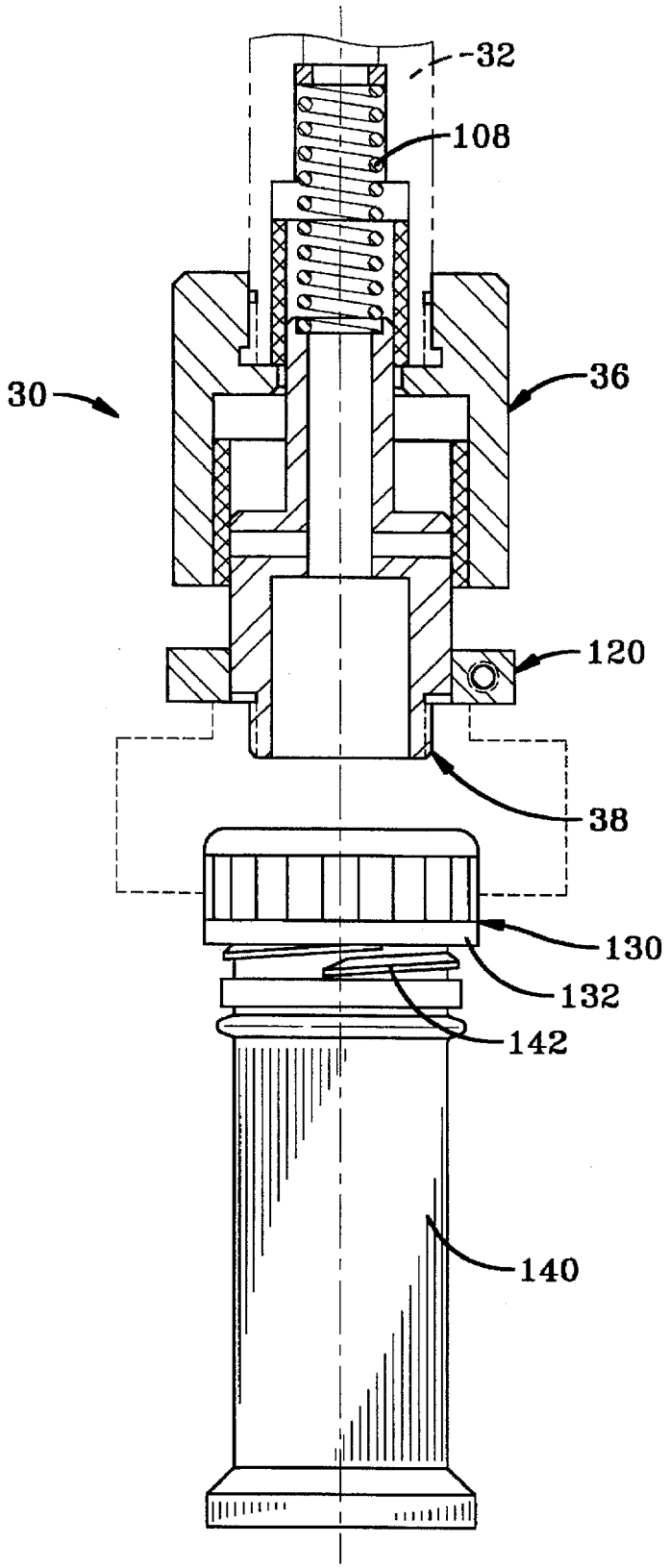

As illustrated in FIG. 21, the capping machine spindle 32 is lowered toward the container 140. In FIG. 21, the spindle 32 has not moved all the way down to the fully lowered position. However, a bottom portion of the cap 130, such as the tamper band 132, has just engaged the highest, upper surface of the container threads 142. This provides a resisting force to further downward movement of the cap 130. The spring 108 may be slightly compressed, but is not fully compressed. Thus, the full force or weight of the spindle 32 is not imposed at this time on the cap 130 and container 140. The cap 130 will momentarily remain at the initial contact elevation illustrated in FIG. 21 along with the capping head 34 and second adapter 38 when the contact resistance exceeds the spring force plus the combined weight of the cap 130, head 34, second adapter 38, and spring 108.

However, the spindle 32 and attached first adapter 36 continue moving downwardly as illustrated in FIG. 22 until the bottom of the first adapter 36 engages the top surface of the travel stop collar 120 so that the two adapters 36 and 38 define a fully collapsed orientation. The spring 108 is not, however, fully compressed at this point, and is never compressed more than what is shown in FIG. 22. Until the bottom of the first adapter 36 engages the travel stop collar 120 as shown in FIG. 22, the axial load on the cap 130 as it contacts the container 140 is equal to the combined total weight of the cap 130, the weight of the capping head 34, the weight of the second adapter 38, the weight of the spring 108, and the force of the spring 108.

In a presently preferred embodiment, the total force on the cap 130 and container 140 prior to the first adapter 36 engaging the travel stop collar 120 is about 5 pounds (i.e., when the components of the apparatus 30 are in the positions shown in FIG. 21 and until just prior to reaching the positions shown in FIG. 22). After the travel stop collar 120 is engaged by the first adapter 36 (FIG. 22), the full load of the capping machine spindle 32 is transferred from the spindle 32 by the first adapter 36, through the collar 120, through the second adapter 38, and through the capping head 34 to the cap 130. The full load of the capping machine spindle 32 is typically much greater than 5 pounds, and in one type of machine is about 22 pounds. The additional force is sufficient to push the tamper band 132 over the outside diameter portions of the thread 142 on the container 140. Without such an increased force, the tamper band 132 may not properly be forced over the threads 142. If a tamper band 132 is not provided on the cap 130, the additional force applied to the cap 130 will insure that the thread on the cap 130 properly engages the container thread 142.

Although the spindle 32 is rotating so that cap 130 is rotating when the cap 130 initially engages the container 140, the thread start on the cap 130 may not be precisely aligned for engaging the mating thread start on the container 140. The additional force of the capping machine spindle 32 also insures that the cap and container threads will engage as the spindle 32 continues rotating.

To insure a proper thread start engagement, the lowermost position of the capping machine spindle 32 preferably is set such that the cap will be forced to an elevation where there is about a 1/16 inch overlap of the cap thread relative to the container thread 142 when the first adaptor is low enough to just engage the collar 120. The setting of the lowermost position of the spindle 32 is effected by conventional mechanisms that are part of the capping machine, the detailed design and operation of which form no part of the present invention. If the cap 130 and container 140 are plastic, the leading portions of the cap and container threads will usually snap into engagement as the weight of the spindle 32 forces the cap thread down to the 1/16 inch overlap elevation which corresponds to the pre-set limit stop of the spindle 32 at its lowermost position.

However, if the cap and container are fabricated from more rigid materials, continued rotation of the spindle 32 (e.g., for about 10 degrees after the first contact between the cap thread and the container thread) will threadingly drive the leading portions of the threads into engagement rather than snap them into engagement. It will be appreciated that conventional capping machines permit the capping spindle 32 to "float" if an upward resistance force is encountered that is greater than the weight of the capping machine spindle column. In effect, with a rigid thread system, the spindle 32 would be very briefly maintained at the elevation corresponding to the initial contact between the cap and container threads while the cap continues to rotate a few degrees to initiate threaded engagement between the cap and container threads. As the cap with rigid threads rotates, the spindle 32 will move down (owing to the helix angle of the threads) the additional, short distance to the pre-set, lowermost position.

Figure 23:
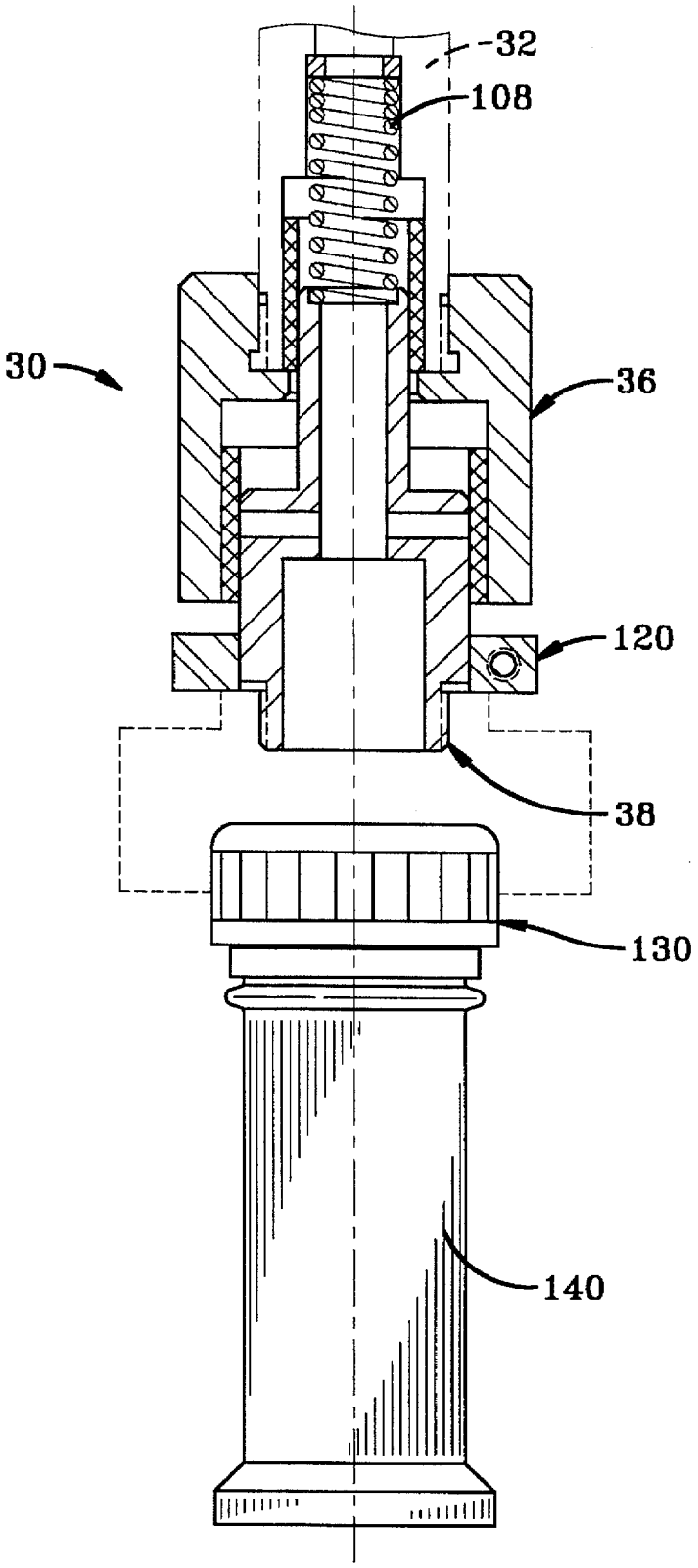

As soon as there is sufficient thread engagement between the cap 130 and container 140, the cap begins to be pulled downwardly by the container thread 142 owing to the continuous rotation of the cap 130 via the rotating spindle 32. This immediately pulls the engaged capping head 34 and second adapter 38, along with the attached travel stop collar 120, downwardly away from the bottom of the first adapter 36 as illustrated in FIG. 23. As this occurs, the spindle 32 reaches its pre-set lowermost position, and the full weight load of the capping machine spindle 32 is thus removed from the cap 130. The cap 130 is then once again subjected only to the force of the spring 108 and combined weight of the cap 130, capping head 134, second adapter 38, and spring 108. This much lower force, typically about 5 pounds in the presently preferred embodiment, is thus present during the majority of the threading action as the cap 130 moves from an initial engagement with the cap thread 142 (FIG. 22) to full threaded engagement (FIG. 24).

The lower axial load on the cap and container thread during the majority of cap threading operation is especially advantageous when a plastic cap 130 is screwed onto a plastic container 140 because the generation of undesirable particulate matter is eliminated or very significantly reduced at the lower axial load. Further, the use of a lower axial load for most of the threading operation reduces the stresses in the cap and container threads and also minimizes the potential for damaging the cap and/or container.

Figure 24:
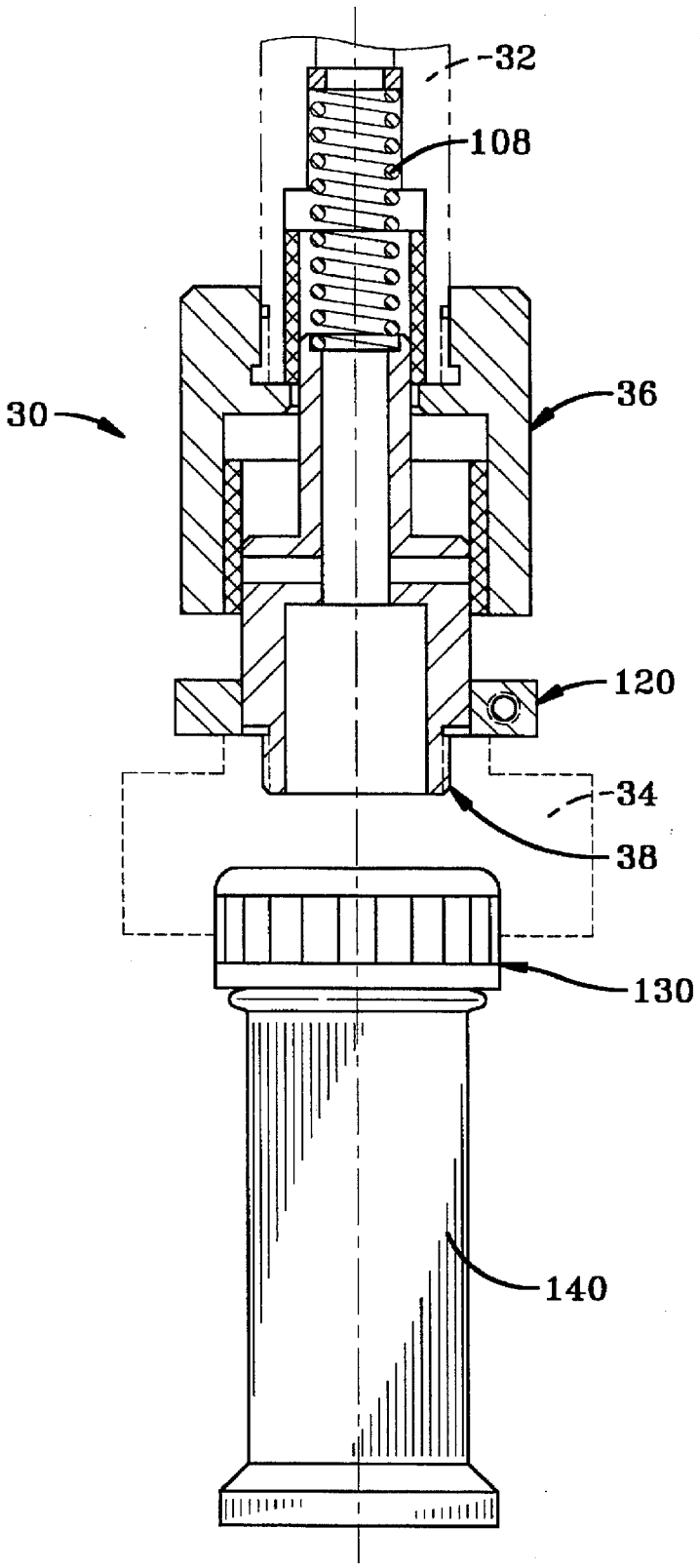

The cap threading operation is complete when the cap 130 has been fully threaded on the container 140 as illustrated in FIG. 24. Increased threading resistance is sensed by the capping machine (typically through a conventional magnetic clutch (not illustrated and which forms no part of the present invention)) which operates to disengage the applied torque at a pre-set level. The capping machine can then be operated to lift the capping head off of the cap 130 and release the cap 130. The operation of the capping machine to disengage the capping head 34 from the cap 130 forms no part of the present invention. A suitable, conventional knockout rod can be driven through the spindle 32 and through the center of the apparatus 30, if desired, to insure removal of any cap which was not properly threaded onto a container 140. The particular design and operation of the capping machine with respect to raising and lowering the spindle 32 (and any knockout rod) forms no part of the present invention.

Figure 25:
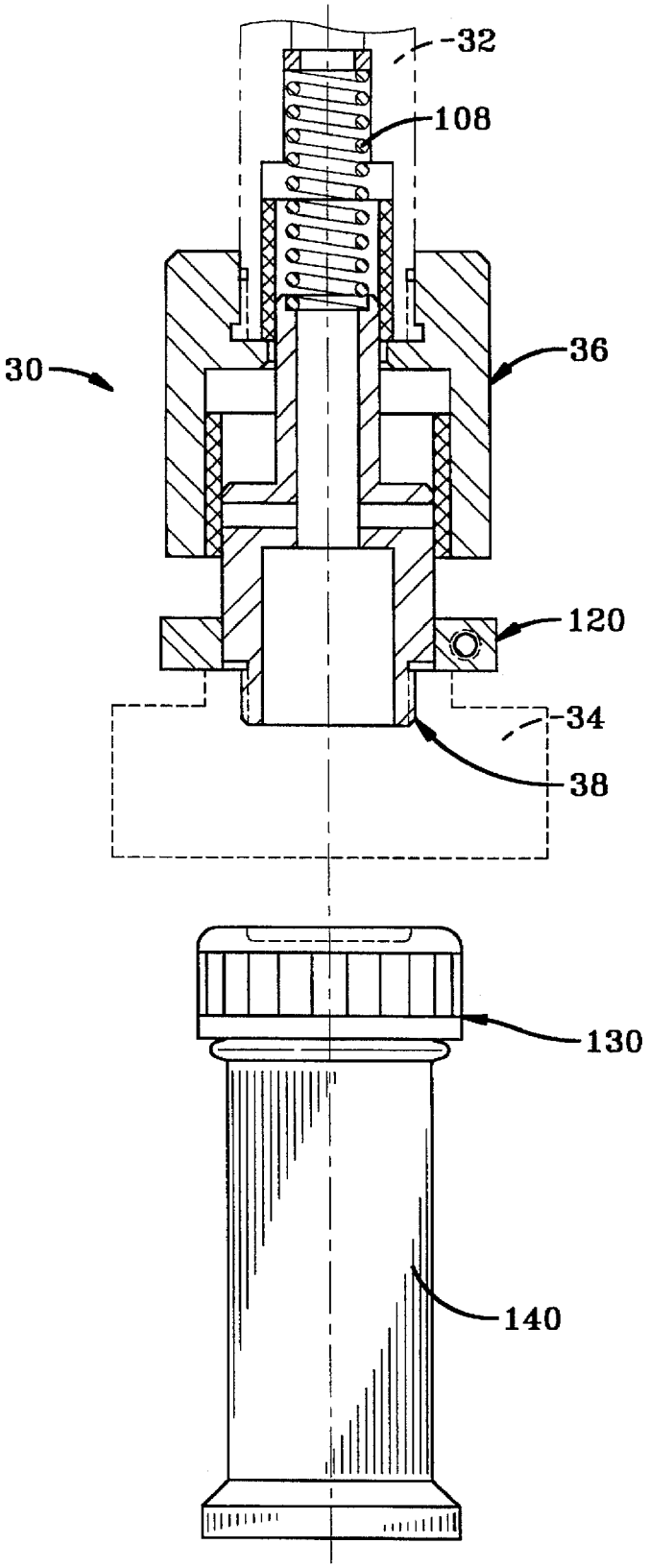

After the cap 130 is released, the spindle 32 is raised back to the first, elevated position to hold the components above the capped container 140 as shown in FIG. 25.

The adapter system 30 may be employed with caps that do not have a tamper band. The installation of a cap that does not have a tamper band may be advantageously effected with the apparatus 30 employing the sequential, high axial load/low axial load process because the high axial load will insure a proper starting engagement of the cap thread with the container thread.

On the other hand, in some applications it may be desirable to provide only a relatively low axial load during all stages of the threading process. This might be useful with some types of plastic, threaded caps and some types of plastic containers. To this end, the apparatus 30 can be modified to apply only a single, low axial load by eliminating the mechanism that effects engagement between the first adapter 36 and the second adapter 38 as the cap is initially engaged with the container. Specifically, with reference to FIG. 22, the travel stop collar 120 could be omitted from the apparatus 30. Sufficient axial clearances would be provided between portions of the spindle 32 and/or first adapter 36 on the one hand, and axially opposing portions of the second adapter 38 and/or capping head 34 on the other hand. The spring 108 would accommodate as much telescoping movement as necessary and would maintain a substantially constant, low axial load on the cap 130 during the threading process. Of course, the spring 108 could be eliminated entirely if the combined weight of the second adapter 38, capping head 34, and cap 130 provided the precise load that was desired.

It will be appreciated that when the use of a travel stop is desired to provide the sequential, high axial loadflow axial load process, a radially extending collar, such as the collar 120 (FIGS. 1, 2, 18, and 19), may be omitted, and the function performed by other structures. For example, with reference to FIG. 1, the upper surface of the second adapter lower portion 74 may be designed to engage the top of the bore 46 in the first adaptor 36 at an appropriate relative position of the two adapters. Alternatively, the upper end of the second adaptor upper portion 72 might be designed to engage a portion of the spindle 32. In another alternate design, the system could terminate the movement of the first adaptor 36 downwardly relative to the second adapter 38 upon full compression of the spring 108.

It will also be appreciated that the novel apparatus of the present invention may be employed with a capping machine that is oriented generally horizontally for applying an overcap to a horizontally disposed container that already has a primary seal. Because the apparatus can be operated with the spring 108, there is no need to rely on gravity to pull the second adapter 38 downwardly. However, in such a horizontally disposed system, the above-described alternate form of operation without a spring 108 would not be possible.

Finally, it will be apparent that the first adapter 36 may be designed to be received inside, instead of outside, of the second adapter 38.

It will also be readily apparent from the foregoing detailed description of the invention and from the illustrations thereof that numerous other variations and modifications may be effected without departing from the true spirit and scope of the novel concepts or principles of this invention.

What is claimed is:

1. An apparatus for placing a cap on a container, said apparatus comprising:

a rotatable spindle reciprocable between a first position and a second position, said rotatable spindle having a proximal end portion and a distal end portion, said proximal end portion constructed to be attached to a capping machine;

a first adapter mounted on said distal end portion of said spindle, said first adapter defining an upper bore, an intermediate bore, and a lower bore, said upper and lower bores connected by said intermediate bore;

a second adapter having a proximal end portion and a distal end portion, said second adapter reciprocably mounted on said first adapter to accommodate relative movement of said adapters between a collapsed orientation and an extended orientation, wherein said adapters are moved towards said collapsed orientation as said rotatable spindle moves from said first position to said second position, said second adapter including a lower portion constructed to be received in said first adapter lower bore, said second adapter including an upper portion projecting from said lower portion, said upper portion constructed to project through said first adapter intermediate bore and into said first adapter upper bore;

a compression spring acting between said first and second adapters; and a capping head having a proximal end portion and a distal end portion, said proximal end portion of said capping head mounted on said distal end portion of said second adapter, said capping head distal end portion constructed to retain releasably a cap.

2. An apparatus for placing a cap on a container in accordance with claim 1, wherein said apparatus further comprises a travel stop collar mounted on said second adapter, and wherein said first adapter contacts said travel stop collar when said first and second adapters are in said collapsed orientation.

3. An apparatus for placing a cap on a container in accordance with claim 2, wherein said travel stop collar is integrally formed on said second adapter.

4. An apparatus for placing a cap on a container in accordance with claim 1, wherein said adapters are moved to said collapsed orientation when said rotatable spindle reaches an intermediate position intermediate said first and second positions, and wherein said adapters remain in said collapsed orientation as said rotatable spindle moves from said intermediate position to said second position.

5. An apparatus for placing a cap on a container in accordance with claim 1, wherein:

said first adapter includes a key projecting radially inwardly into said first adapter lower bore; and said second adapter lower portion includes a keyway receiving at least a portion of said key.

6. A method for applying a cap having a tamper band to a container, said method comprising the steps of:

providing an apparatus for placing a cap on a container, said apparatus comprising:

a rotatable spindle reciprocable between a first position and a second position, said rotatable spindle having a proximal end portion and a distal end portion, said proximal end portion constructed to be attached to a capping machine;

a first adapter mounted on said distal end portion of said spindle, said first adapter defining an upper bore, an intermediate bore, and a lower bore, said upper and lower bores connected by said intermediate bore;

a second adapter having a proximal end portion and a distal end portion, said second adapter reciprocably mounted on said first adapter to accommodate relative movement of said adaptors between a collapsed orientation and an extended orientation, wherein said adapters are moved towards said collapsed orientation as said rotatable spindle moves from said first position to said second position, said second adapter including a lower portion constructed to be received in said first adapter lower bore, said second adapter including an upper portion projecting from said lower portion, said upper portion constructed to project through said first adapter intermediate bore and into said first adapter upper bore;

a compression spring acting between said first and second adapters; and a capping head having a proximal end portion and a distal end portion, said proximal end portion of said capping head mounted on said distal end portion of said second adapter, said capping head distal end portion constructed to retain a cap;

providing a cap having threads thereon, said cap also having a tamper band thereon;

placing said cap in said distal end portion of said capping head;

providing a container constructed to receive said cap thereon, said container having mating threads thereon;

aligning said container with said cap;

moving said rotatable spindle from said first position to an intermediate position between said first and second positions, said tamper band contacting said mating threads on said container when said rotatable spindle is in said intermediate position, said adapters being in said collapsed orientation when said rotatable spindle is in said intermediate position;

moving said rotatable spindle from said intermediate position to said second position, said threads on said cap engaging said mating threads on said container when said rotatable spindle is in said second position, said adapters remaining in said collapsed orientation as said rotatable spindle is moved from said intermediate position to said second position;

threadingly securing said cap on said container, said threadingly securing step comprising rotating said rotatable spindle, said second adapter moving away from said first adapter as said cap is threadingly secured to said container; and releasing said cap from said distal end portion of said capping head.

7. A method for applying a cap having a threads thereon to a container having mating threads thereon, said method comprising the steps of:

providing an apparatus for placing a cap on a container, said apparatus comprising:

a rotatable spindle reciprocable between a first position and a second position, said rotatable spindle having a proximal end portion and a distal end portion, said proximal end portion constructed to be attached to a capping machine;

a first adapter mounted on said distal end portion of said spindle, said first adapter defining on upper bore, an intermediate bore, and a lower bore, said upper and lower bores connected by said intermediate bore;

a second adapter having a proximal end portion and a distal end portion, said second adapter reciprocably mounted on said first adapter to accommodate relative movement of said adapters between a collapsed orientation and an extended orientation, wherein said adapters are moved towards said collapsed orientation as said rotatable spindle moves from said first position to said second position, said second adapter including a lower portion constructed to be received in said first adapter lower bore, said second adapter including an upper portion projecting from said lower portion, said upper portion constructed to project through said first adapter intermediate bore and into said first adapter upper bore;

a compression spring acting between said first and second adapters; and a capping head having a proximal end portion and a distal end portion, said proximal end portion of said capping head mounted on said distal end portion of said second adapter, said capping head distal end portion constructed to retain a cap;

providing a cap having threads thereon;

placing said cap in said distal end portion of said capping head;

providing a container constructed to receive said cap thereon, said container having mating threads thereon;

aligning said container with said cap;

moving said rotatable spindle from said first position to said second position, said threads on said cap engaging said mating threads on said container when said rotatable spindle is in said second position, said adapters being in said collapsed orientation when said rotatable spindle is in said second position;

threadingly securing said cap on said container, said threadingly securing step comprising rotating said rotatable spindle, said second adapter moving away from said first adapter as said cap is threadingly secured to said container; and releasing said cap from said distal end portion of said capping head.

8. An apparatus for placing a cap on a container, said apparatus comprising:

a rotatable spindle reciprocable between a first position and a second position, said rotatable spindle having an intermediate position between said first and second positions, said rotatable spindle having a proximal end portion and a distal end portion, said proximal end portion constructed to be attached to a capping machine;

a first adapter mounted on said distal end portion of said spindle;

a second adapter having a proximal end portion and a distal end portion, said second adapter reciprocably mounted on said first adapter to accommodate relative movement of said adapters between a collapsed orientation and an extended orientation, wherein said adapters are moved towards said collapsed orientation as said rotatable spindle moves from said first position to said second position, said first and second adapters constructed such that said first and second adapters are in said collapsed orientation when said rotatable spindle is in said intermediate position, said first and second adapters constructed such that said first and second adapters are in said collapsed orientation when said rotatable spindle moves from said intermediate position to said second position; and a capping head having a proximal end portion and a distal end portion, said proximal end portion of said capping head mounted on said distal end portion of said second adapter, said capping head distal end portion constructed to retain releasably a cap.

* * * * *